US006027364A

United States Patent [19]

Fukuda

[11] Patent Number: 6,027,364

[45] Date of Patent: Feb. 22, 2000

[54] CONNECTOR FITTING CONSTRUCTION WITH SIDE RIBS AND CORRESPONDING SIDE RIB-RECEIVING PORTIONS

[75] Inventor: Masaru Fukuda, Shizuoka, Japan

[73] Assignee: Yazaki Corporation, Tokyo, Japan

[21] Appl. No.: 09/053,762

[22] Filed: Apr. 2, 1998

[30] Foreign Application Priority Data

Apr. 11, 1997 [JP] Japan ..... 9-094065

[51] Int. Cl.[7] ..... H01R 3/00

[52] U.S. Cl. ..... 439/489; 439/923; 439/374; 439/533

[58] Field of Search ..... 439/489, 923, 439/374, 680, 527, 574, 575, 533, 545

[56] References Cited

U.S. PATENT DOCUMENTS

| | | | |
|---|---|---|---|
| 3,141,721 | 7/1964 | Horn | 439/680 |
| 3,697,927 | 10/1972 | Kunkle et al. | 439/374 |
| 4,521,066 | 6/1985 | Kempe | 439/320 |
| 4,741,706 | 5/1988 | Takeda et al. | 439/318 |
| 5,382,179 | 1/1995 | Noschese | 439/533 |
| 5,435,748 | 7/1995 | Abe | 439/489 |
| 5,605,471 | 2/1997 | Plyler | 439/489 |
| 5,848,912 | 12/1998 | Okabe | 439/489 |

FOREIGN PATENT DOCUMENTS

| | | |
|---|---|---|
| 5-81967 | 11/1993 | Japan . |
| 6-89759 | 3/1994 | Japan . |

*Primary Examiner*—Paula Bradley
*Assistant Examiner*—Tho D. Ta
*Attorney, Agent, or Firm*—Sughrue, Mion, Zinn, Macpeak & Seas, PLLC

[57] ABSTRACT

A connector fitting construction in which a pair of male and female connectors can be fitted together easily, and a housing can be formed into a small size, and two connectors can be held in a good mutually-fitted condition. In the connector fitting construction, side rib-receiving portions are formed in an inner surface of a hood portion of a male connector, and a notch is formed in one side wall of the hood portion. An under-rib is formed on an outer surface of an inner housing. Side ribs are formed respectively on opposite side walls of a housing of a female connector, and extend in a connector-fitting direction. A bracket for mounting on other member is formed on an outer surface of the housing.

2 Claims, 9 Drawing Sheets

1
3
3c
4
4a
5
6
7
8
8a
9
9
10
11
12
13
14
15
16
17
19
31
33

CONNECTOR FITTING CONSTRUCTION WITH SIDE RIBS AND CORRESPONDING SIDE RIB-RECEIVING PORTIONS

BACKGROUND OF THE INVENTION

1. Field of the Invention

This invention relates to a connector fitting construction in which a half-fitted condition is positively prevented by a resilient force of a resilient member mounted in a housing of at least one of a pair of male and female connectors to be fitted together, and the two connectors are kept in a good mutually-fitted condition.

2. Background

Usually, many electronic equipments for effecting various controls are mounted on a vehicle such as an automobile, and therefore, naturally, many wire harnesses and flat cables have been used. Automobiles and the like are used in a severe environment in which vibrations and submergence are encountered, and therefore there have been used various types of female and male connectors which have a waterproof function, and can be easily connected to and disconnected from a wire harness or the like in view of the efficiency of an assembling operation and the efficiency of the maintenance.

Various half-fitting prevention connectors, in which a condition of fitting between female and male connectors, can be detected, have been used, and one such half-fitting prevention connector is disclosed in Unexamined Japanese Utility Model Publication No. Hei. 5-81967.

One example of conventional half-fitting prevention connector will now be described with reference to FIGS. 8 and 9. A pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having an open front side, and a guide plate 55 for guiding the fitting of the socket-type connector 51 is mounted centrally of the height within the housing 54, and divides the interior of the housing 54 into an upper portion and a lower portion. Within the housing 54, the pin contacts 52 extend from a rear portion toward the front side of this housing. A notch is formed in a middle portion of a top plate 54*b*, and an engagement piece portion 56 is formed integrally with the top plate 54*b* so as to extend frontwardly, and is disposed in this notch. A distal end of the engagement piece portion 56 is receded from the front edge of the top plate 54*b*, and is cantilevered to have a flexibility. An engagement projection 56*a* is formed on the inner side of the distal end of the engagement piece portion 56.

The socket-type connector 51 includes a box-shaped housing 57 to be fitted into the opening in the housing 54 of the pin-type connector 50. Pin holes 58 for respectively receiving the pin contacts 52, and a slot 59 for receiving the guide plate 55 are provided in the front side of the housing 57.

A movable cover 60 is fitted on the housing 57 for movement back and forth, and covers the housing 57 except front and rear end portions thereof. An opening 61, for receiving the pin-type connector 50, is formed in the front side of the movable cover 60. The opening 61 has such a size as to receive the opposite side plates 54*a*, the top plate 54*b* and a bottom plate 54*c* of the housing 54.

A pair of opposed spring receiving portions (not shown) are formed respectively at opposite side portions of the movable cover 60 and hence at opposite side portions of the housing 57, and springs 64 are received respectively in the spring receiving portions, each of the springs 64 extending in the forward-backward direction. The movable cover 60 is normally urged forward by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* of the engagement piece portion 56 is engaged in the engagement groove 67 when the two connectors are completely connected together. The engagement groove 67 is normally concealed by the movable cover 60, and appears when the movable cover 60 is moved.

When the two connectors 50 and 51 are fitted together, the pin contacts 52 contact the socket contacts 53, respectively, and the engagement projection 56*a* is engaged in the engagement groove 67, as shown in FIG. 9. In this fitted condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a half-fitted condition is encountered, the distal end of the engagement piece portion 56 abuts against the edge of the opening in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together.

In the connectors 50 and 51, however, the half-fitted condition can be prevented, but when trying to fit the two connectors 50 and 51 together while holding the opposite side surfaces of the movable cover 60 with the hand, the movable cover 60 can not be moved, so that the fitting operation can not be effected.

The opposed spring receiving portions are provided respectively at the opposite side portions of the housing 57 and at the opposite side portions of the housing 57, and besides the movable cover 60 is mounted on the outer periphery of the housing 57, so that the socket-type connector 51 has an increased size, and therefore this construction is not suitable for a small-size connector for connecting a few female and male contacts together.

There is also known the type of half-fitting prevention connector which includes a housing for receiving a lock member for locking two connectors together in a mutually-fitted condition, and another separate housing having terminal receiving chambers for respectively receiving contacts. In this type of connector, when wires are pulled obliquely, the two housings are often flexed away from each other, which results in a problem that the force to hold the two connectors together is reduced.

SUMMARY OF THE INVENTION

With the above problems in view, it is an object of this invention to provide a connector fitting construction in which a pair of male and female connectors can be fitted together easily, and a housing can be formed into a small size, and two connectors can be held in a good mutually-fitted condition.

According to the first aspect of the invention, there is provided a connector fitting construction including a first connector including a first housing having a first terminal receiving chamber into which a first terminal is insertable; a second connector including a second housing having a second terminal receiving chamber into which a second terminal is insertable, and a resilient member provided in the second housing, in which the first connector and the second connector are fittable to each other so that the first terminal and the second terminal are connected with each other, and a half-fitted condition between the first connector and the second connector is prevented by a resilient force of the resilient member; side ribs formed respectively on opposite side of the first housing, the side ribs extending in a connector fitting direction; and side rib-receiving portions respectively receiving the side ribs when the first connector and the second connector are fitted to each other, the side rib-receiving portions being formed in an inner surface of the second housing.

In this connector fitting construction, the side ribs are formed respectively on the opposite side walls of the first housing of the first connector, and extend in the connector fitting direction, and the side rib-receiving portions for respectively receiving the side ribs are formed in the inner surface of the second housing of the second connector, and therefore the operation of fitting the two connectors together can be effected while fitting the side ribs respectively into the side rib-receiving portions.

Therefore, the operation of fitting the first and second connectors together can be effected easily, and even if an external force is applied to the first and second connectors, fitted together, through wires or the like, the stable housing-holding force is maintained.

According to the second aspect of the invention, in the connector fitting construction according to the first aspect of the invention, the second connector further includes an inner housing provided on the second housing, the first connector further includes a housing insertion hole into which the inner housing of the second connector is insertable, and a bracket formed on an outer surface of the first housing, the bracket serving as one side wall of the housing insertion hole, and a notch is formed in one side wall of the second housing corresponding to the bracket.

In this connector fitting construction, the bracket serves also as one side wall of the housing insertion hole in the first connector, and the notch is formed in one side wall of the second housing of the second connector corresponding to the bracket. Therefore, the housings, when fitted together, can have a smaller size.

According to the third aspect of the invention, in the connector fitting construction according to the second aspect of the invention, the second connector further includes an under-rib formed on an outer surface of the inner housing of the second connector, the first connector further includes an under-rib receiving portion into which the under-rib is insertable, the under-rib receiving portion being formed in the bracket.

In this connector fitting construction, in addition to the side ribs of the first connector and the side rib-receiving portions of the second connector, the under-rib and the under-rib receiving portion are provided respectively at the second connector and the first connector. Therefore, even if an external force is applied to the connectors fitted together, the more stable housing-holding force can be maintained.

DETAILED DESCRIPTION OF THE PREFERRED EMBODIMENT

One preferred embodiment of a connector fitting construction of the present invention will now be described in detail with reference to FIGS. 1 to 7.

Figure 1:
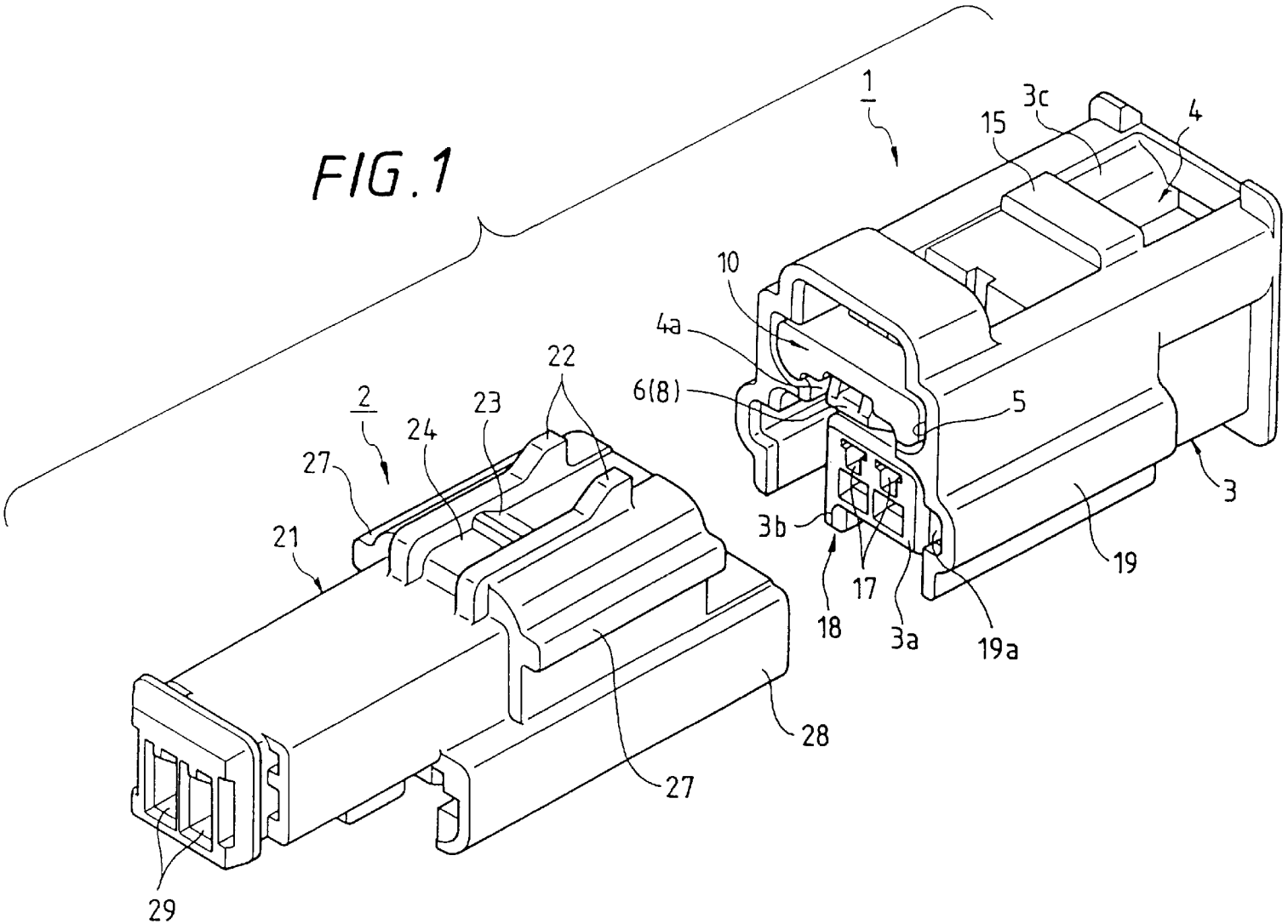
FIG. 1 is an exploded, perspective view showing one preferred embodiment of a connector fitting construction of the invention.

As shown in FIG. 1, the connector fitting construction of this embodiment includes a pair of male and female connectors 1 and 2. An inner housing 3*a* is formed within a housing 3 of the male connector 1, and this inner housing 3*a* has terminal receiving chambers (through holes) 17 for respectively receiving a predetermined number of (two in this embodiment) socket contacts 31. A slider receiving portion 4 for slidably receiving a slider (slide lock member) 10 is formed above the inner housing 3*a,* and the male connector 1 further includes a hood portion (outer housing) 19 which forms the slider receiving portion 4, and covers the inner housing 3*a* in suitably spaced relation thereto.

Side rib-receiving portions 19*a* for respectively receiving side ribs 27 on the female connector 2 are formed respectively in an inner surface of the hood portion 19, and extend in a fitting direction.

An under-rib 3*b* is formed on a lower surface (in the drawings) of the inner housing 3*a,* and extends in the fitting direction, and a notch 18 is formed in that portion of the hood portion 19 facing the lower side (in the drawings) of the inner housing 3*a* having the under-rib 3*b.* Therefore, the lower side (in the drawings) of the inner housing 3*a* is not covered with the hood portion 19, and hence the inner housing 3*a* is exposed to the exterior.

Figure 2:
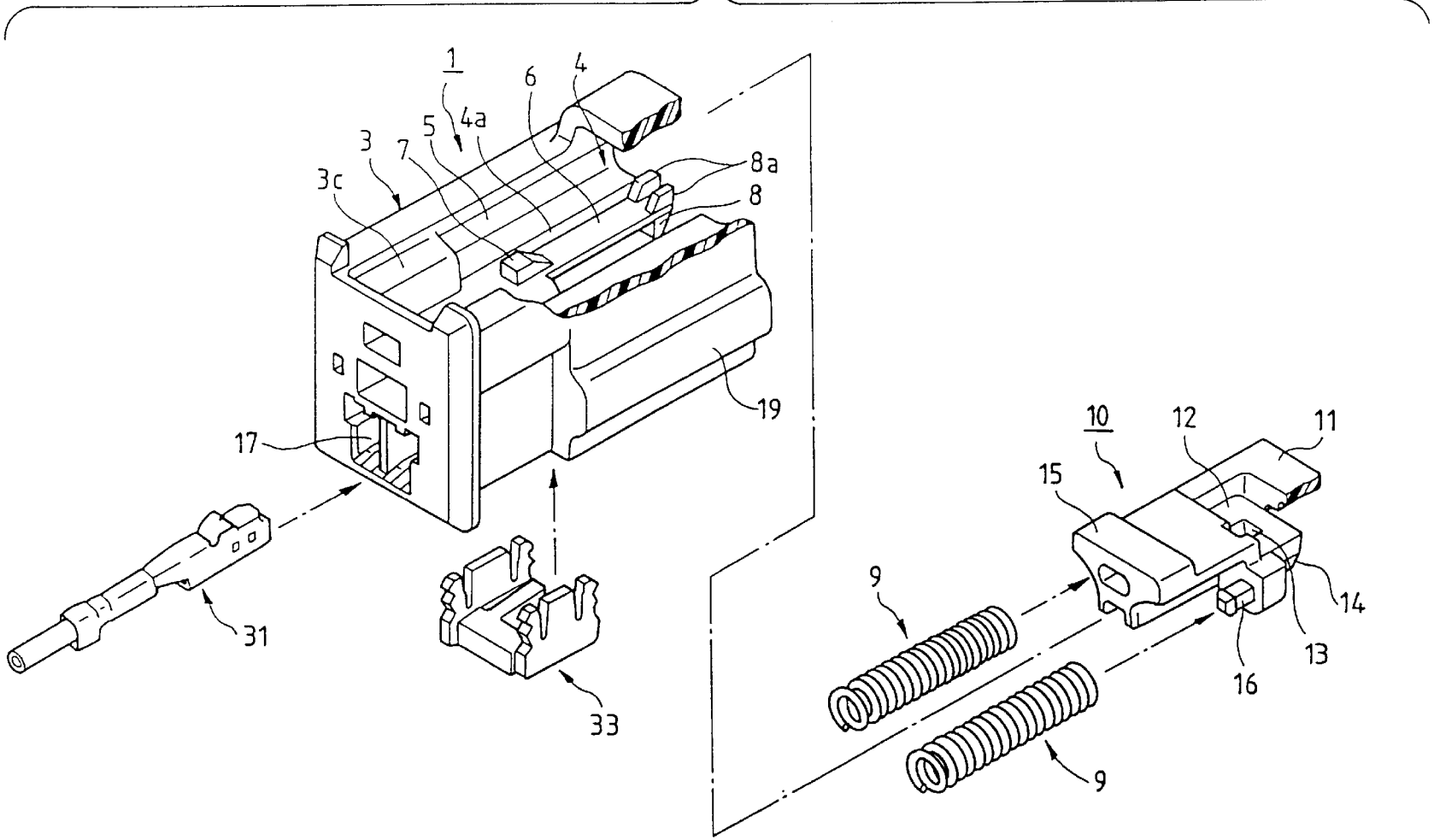
FIG. 2 is an exploded, perspective view of a male connector in FIG. 1.

As shown in FIGS. 1 and 2, guide grooves 5 for respectively guiding opposite side portions of a slider body 11 are formed respectively at opposite side portions of the slider receiving portion 4, and spring receiving portions 3*c* of a tubular shape are formed at rear ends of the guide grooves 5, respectively.

A lock arm (elastic member) 6 of the cantilever type is formed integrally at a central portion of the slider receiving portion 4, and extends in the fitting direction. A lock beak 7, having a slanting surface, is formed on an upper surface of the lock arm 6, and a housing lock (engagement projection) 8 for retaining engagement with a female housing 21 (described later) is formed on a lower surface of the lock arm 6 at a distal end thereof. Displacement prevention projections 8*a* for preventing the displacement of the lock arm 6 are formed on that portion of the upper surface of the lock arm 6 facing away from the housing lock 8. Side spaces 4*a* for respectively receiving abutment projections 14 of a slider arm 12 (described later) are provided respectively on opposite sides of the lock arm 6.

As shown in FIG. 2, the elastic slider arm 12 of the cantilever type is formed at a generally central portion of the slider body 11 of the slider 10, and this slider arm 12 has the pair of abutment projections 14 formed respectively at opposite side portions of a lower surface thereof at a front end thereof. The slider 10 further includes a press portion 15, which is formed on an upper surface thereof at a rear end thereof, and is operated when releasing the fitted condition, a slide groove (through hole) 13 formed in the slider arm 12 and the press portion 15, and a pair of spring retaining portions 16 which are formed respectively at opposite side portions of the rear end thereof, and retain compression springs 9, respectively.

Figure 4:
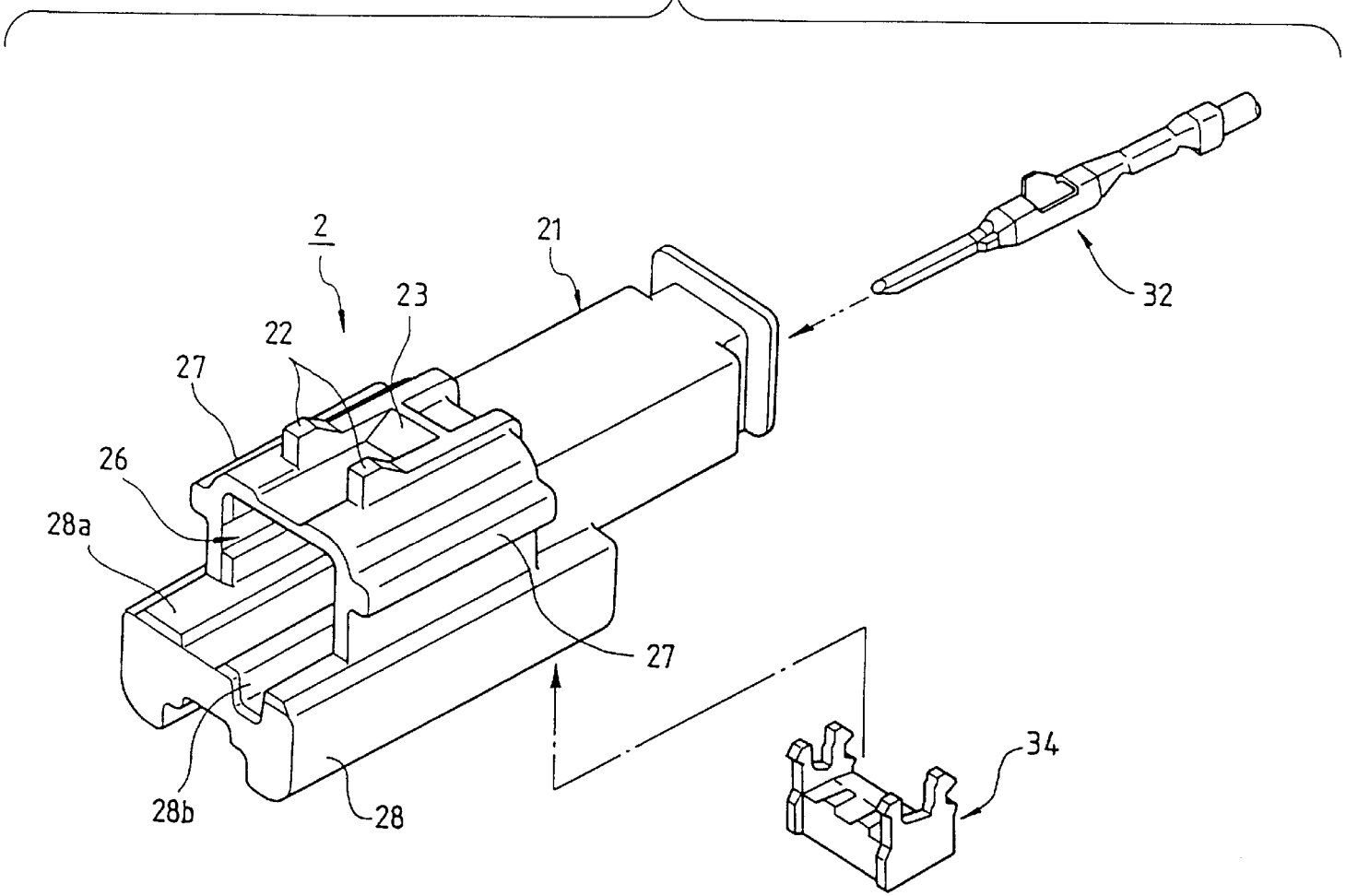
FIG. 4 is an exploded, perspective view of a female connector in FIG. 1.

As shown in FIGS. 1 and 4, the female connector 2 includes terminal receiving chambers (through holes) 29 for respectively receiving a predetermined number of (two in this embodiment) pin contacts 32, and a housing insertion hole 26 open to the front side. A pair of stopper projections 22 for abutting respectively against the abutment projections 14 of the slider 10 when fitting the connectors together are formed on one side surface of the housing 21, and a slanting projection 23, having a slanting surface for flexing the lock arm 6 of the male connector 1, is formed between the stopper projections 22 and 22, and an engagement groove 24 for engagement with the housing lock 8 of the male connector 1 is formed adjacent to the rear end of the slanting projection 23.

The side ribs 27 are formed respectively on opposite side walls of the housing 21, and extend in the connector-fitting direction. A bracket 28 for mounting on other member is formed at the lower side (in the drawings) of the housing insertion hole 26.

An upper surface 28*a* (in the drawings) of the bracket 28 serves also as part of a peripheral wall of the housing insertion hole 26, and covers the notch 18 in the male connector 1 when the male and female connectors are fitted together as described later. An under-rib receiving portion 28*b* for receiving the under-rib 3*b* of the male connector 1 is formed in the upper surface 28*a* of the bracket 28, and extends in the connector-fitting direction.

A procedure of fitting the above male and female connectors together will be described.

Figure 3:
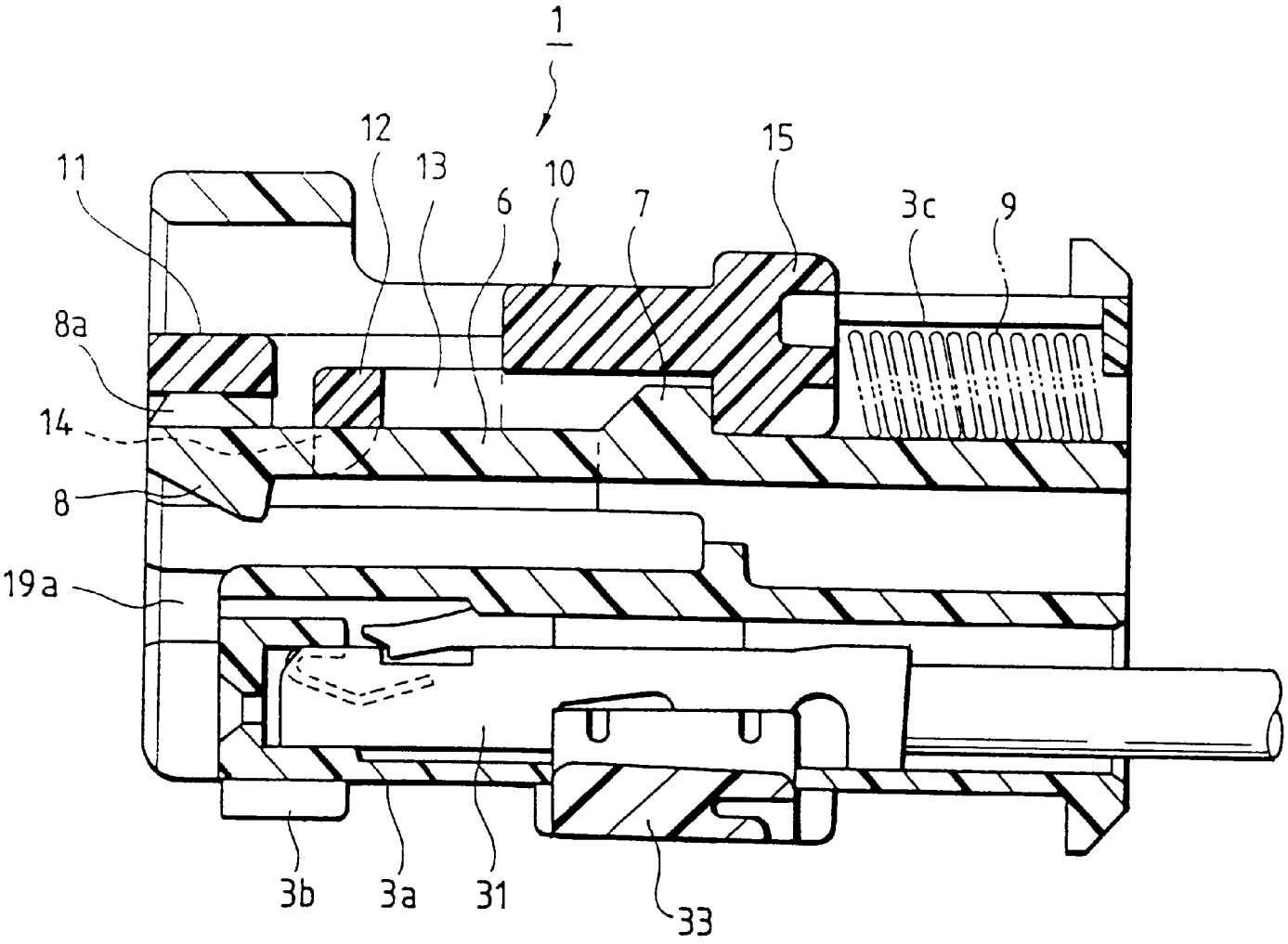
FIG. 3 is a vertical cross-sectional view of the male connector of FIG. 1.

First, for attaching the slider 10 to the male connector 1, the two compression springs 9 are inserted respectively into the spring receiving portions 3*c* from the front side of the male connector 1, and then the opposite side portions of the slider body 11 of the slider 10 are inserted respectively into the guide grooves 5 in the slider receiving portion 4 (see FIGS. 2 and 3). Then, when the slider 10 is pushed into the slider receiving portion 4 in a direction to compress the compression springs 9, the abutment projections 14, formed respectively at the opposite side portions of the lower surface of the slider arm 12, are disposed respectively in the side spaces 4*a* provided respectively on the opposite sides of the lock arm 6. Then, when the slider 10 is further pushed, the lock beak 7 on the lock arm 6 is fitted in the slide groove 13, so that the slider 10 is slidably mounted in the slider receiving portion 4.

In the above condition shown in FIG. 3, the slider 10 is urged in the fitting direction (left in FIG. 3) by the resilient force or bias of the compression springs 9, and the lock beak 7 is retainingly engaged with the rear end of the slide groove 13, and the displacement prevention projections 8*a,* formed at the front end of the lock arm 6, abut against the lower surface of the front end of the slider body 11 of the slider 10, so that the lock arm 6 is prevented from being displaced upward.

Then, as shown in FIG. 2, the socket contacts 31 are inserted respectively into the terminal receiving chambers 17 open to the rear end of the housing 3, and are retained respectively by housing lances provided respectively within the terminal receiving chambers 17, and a socket holder 33 for preventing the rearward withdrawal of the socket contacts 31 is attached to the housing 3 from the lower side thereof.

Figure 5:
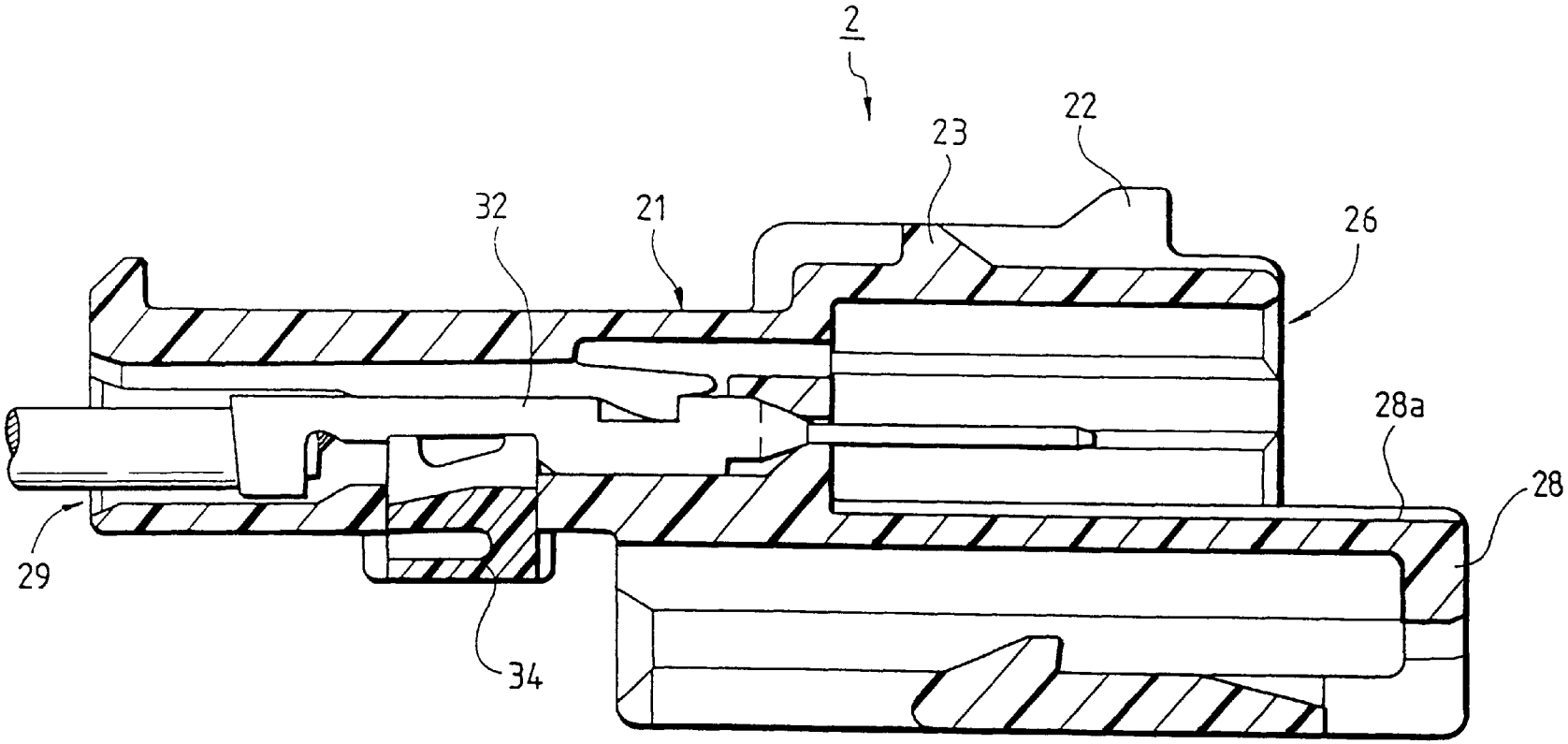
FIG. 5 is a vertical cross-sectional view of the female connector of FIG. 1.

Then, as shown in FIGS. 4 and 5, the pin contacts 32 are inserted respectively into the terminal receiving chambers 29 from the rear side of the housing 21 of the female connector 2, and are retained respectively by housing lances provided respectively within the terminal receiving chambers 29. A pin holder 34 for preventing the rearward withdrawal of the pin contacts 32 is attached to the housing 21 from the lower side thereof.

Next, the operation of fitting the male and female connectors 1 and 2, forming the connector fitting construction of this embodiment, will be described.

The male and female connectors 1 and 2 are brought into opposed relation to each other as shown in FIG. 1, and in this condition the side ribs 27 of the female connector 2 are inserted respectively in the side rib-receiving portions 19*a* of the male connector 1, and also the under-rib 3*b* of the male connector 1 is fitted in the under-rib receiving portion 28*b* of the female connector 2, and in this manner the fitting operation is started.

At this time, the stopper projections 22 of the female connector 2 are fitted respectively into the side spaces 4*a* provided respectively on the opposite sides of the lock arm 6 of the male connector 1, and the stopper projections 22 abut respectively against the abutment projections 14 of the slider 10, and the resilient force is produced by the compression springs 9 compressed when the female connector 2 is pushed into the male connector 1.

Then, when the fitting operation further proceeds, the slider 10 is pushed rearward against the bias of the compression springs 9, and the housing lock 8 at the front end of the lock arm 6 abuts against the slanting projection 23 of the female connector 2. If the pushing operation is stopped in this half-fitted condition, the male and female connectors 1 and 2 are moved away from each other in a disengaging direction (opposite to the fitting direction) by the resilient force (bias) of the compression springs 9, and therefore the half-fitted condition can be easily detected.

Figure 6:
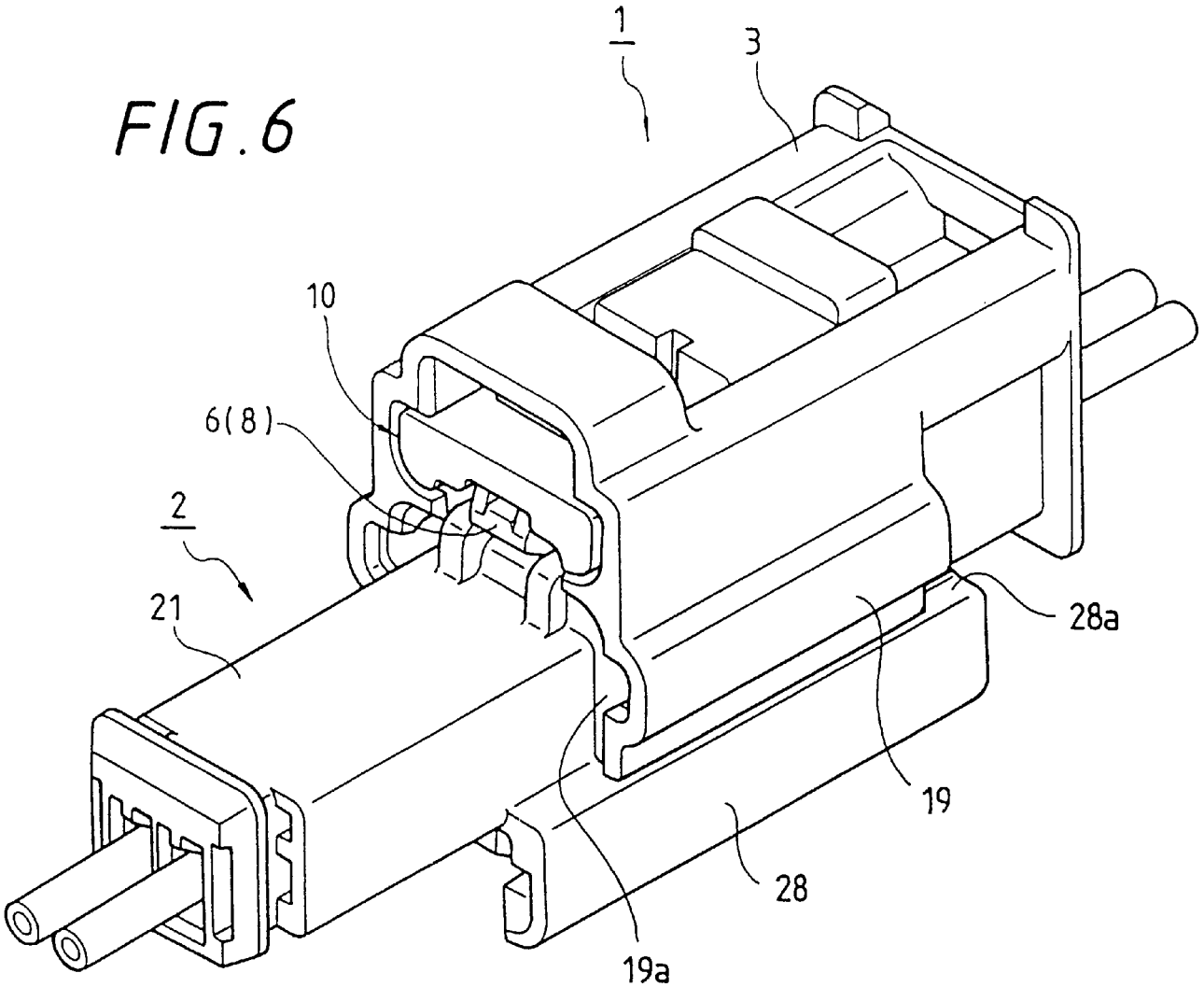
FIG. 6 is a perspective view showing a fitted condition of the connectors in FIG. 1.
Figure 7:
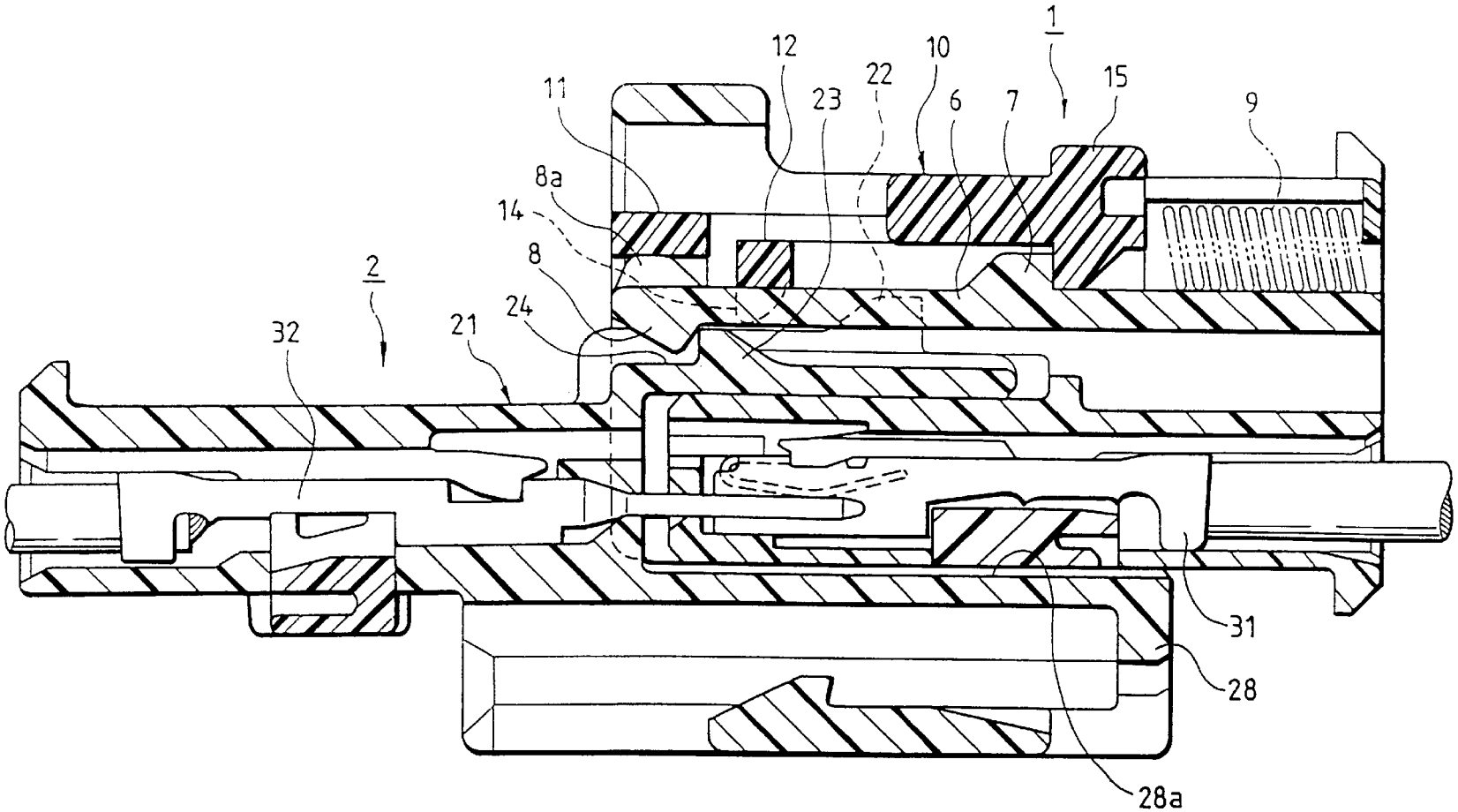
FIG. 7 is a vertical cross-sectional view showing the fitted condition of FIG. 6.
Figure 8:
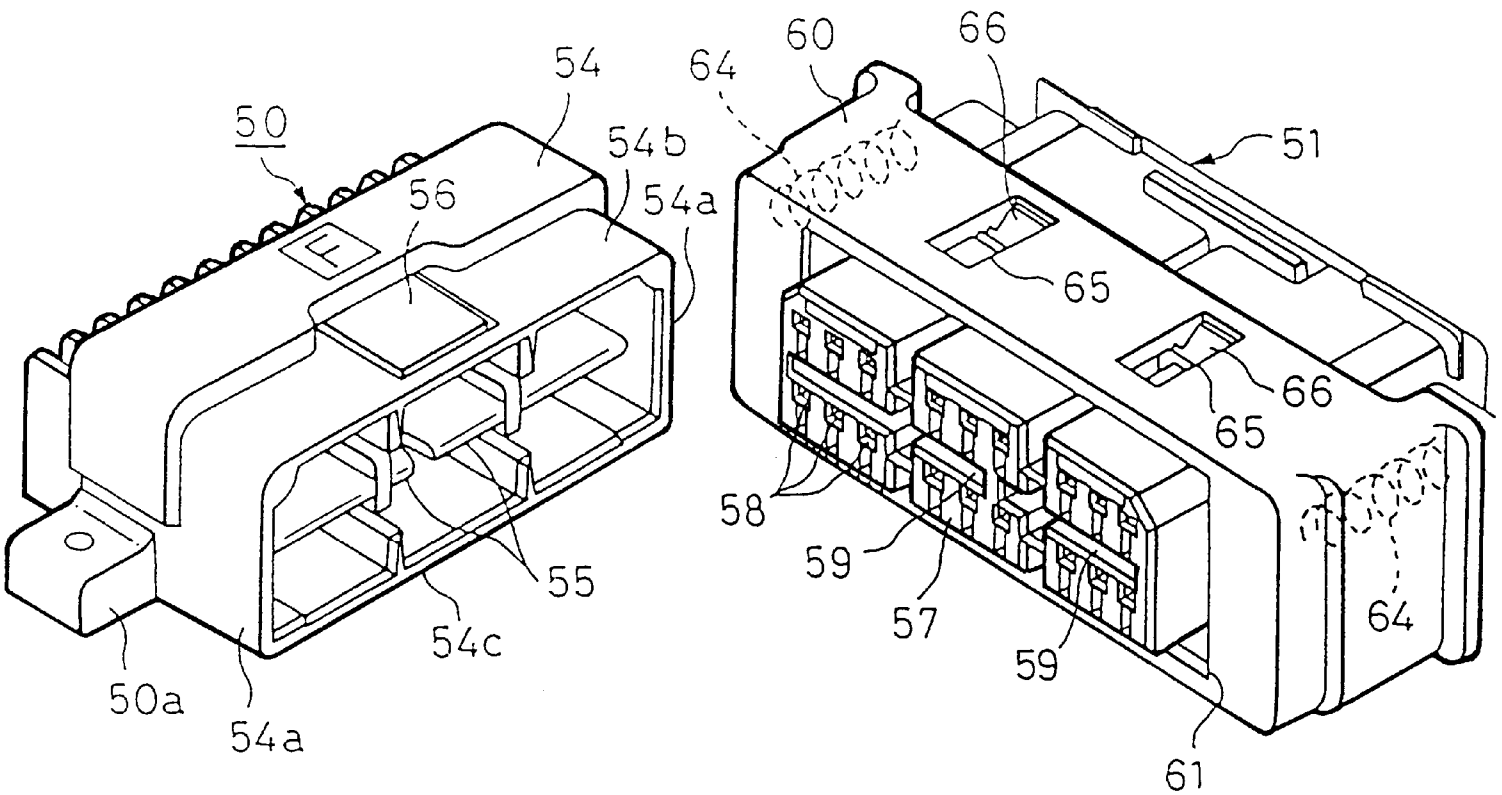
FIG. 8 PRIOR ART
FIG. 8 is a perspective view of a conventional connector construction.
Figure 9:
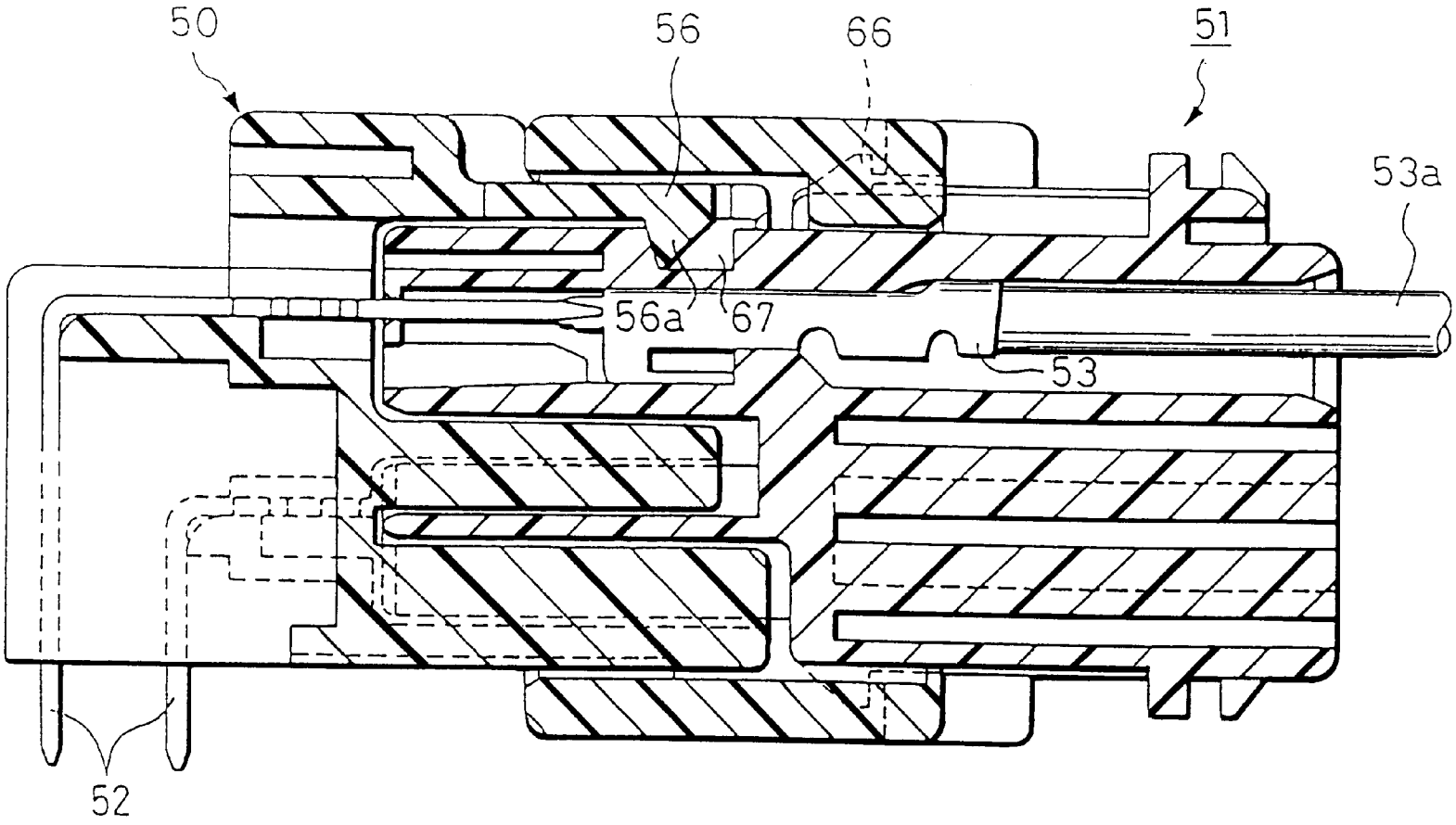
FIG. 9 PRIOR ART
FIG. 9 is a vertical cross-sectional view showing a fitted conditions of connectors of FIG. 8.

Then, when the fitting operation further proceeds as shown in FIGS. 6 and 7, the slider arm 12 of the slider 10 is flexed upwardly by the lock beak 7, so that the abutment of the stopper projections 22 against the abutment projections 14 of the slider 10 is released. Then, because of the resilient force of the compression springs 9, the slider arm 12 slides over the stopper projections 22 to be returned to the initial position, and the housing lock 8 at the front end of the lock arm 6 slides over the slanting projection 23, and is engaged in the engagement groove 24. At this time, the lower surface of the slider body 11 of the slider 10 abuts against the displacement prevention projections 8*a* of the lock arm 6, and therefore is prevented from being flexed, and the male and female connectors 1 and 2 are held in the completely-fitted condition.

As described above, in the connector fitting construction of this embodiment, in a half-fitted condition, the male and female connectors 1 and 2 are moved away from each other by the resilient force of the compression springs 9, thereby preventing the half-fitted condition from being maintained. The male and female connectors 1 and 2 can be fitted together while holding the side wall of the male housing 1 with the hand, and the fitting operation is carried out while fitting the side ribs 27 of the female connector 2 respectively in the side rib-receiving portions 19*a* of the male connector 1, and therefore the efficiency of the fitting operation is enhanced.

Even if an external force is applied to the connectors, fitted together, through wires or the like, the stable housing-holding force is maintained.

Since the slider arm 12 is provided in the slider body 11, the slider 10 can be formed into a small size. And besides, the side spaces 4*a* are provided respectively on the opposite sides of the lock arm 6, and the abutment projections 14 of the slider 10 are disposed respectively in these side spaces 4*a,* and therefore at least the male housing 1, having the slider 10 mounted thereon, can be formed into a small size.

The upper surface 28*a* of the bracket 28 serves also as part of the peripheral wall of the housing insertion hole 26 in the female connector 2, and the notch 18 is formed in one side wall of the hood portion 19 of the male connector 1 corresponding to the bracket 28, and when the male and female connectors 1 and 2 are fitted together, the notch 18 is covered with the upper surface 28*a* of the bracket 28. Therefore, the fitting construction, formed by the male and female connectors 1 and 2, can be made smaller in size.

As described above, in the connector fitting construction of the present invention, the side ribs are formed respectively on the opposite side walls of the housing of the other housing, and extend in the connector fitting direction, and the side rib-receiving portions for respectively receiving the side ribs are formed in the inner surface of the outer housing of the one connector.

Therefore, the operation of fitting the two connectors together can be effected while fitting the side ribs respectively in the side rib-receiving portions, and therefore the efficiency of the fitting operation is enhanced, and even if an external force is applied to the connectors, fitted together, through the wires or the like, the stable housing-holding force is maintained.

The bracket for mounting on other member is formed on the outer surface of the housing of the other connector, and the bracket serves also as one side wall of the housing insertion hole in the other connector, and the notch is formed in one side wall of the outer housing of the one connector corresponding to the bracket. Therefore, the connectors, when fitted together, can have a small size.

The under-rib is formed on the outer surface of the inner housing of the one connector, and the under-rib receiving portion for receiving the under-rib is formed in the bracket of the other connector.

Therefore, even if an external force is applied to the connectors fitted together, the more stable housing-holding force can be maintained.

What is claimed is:

1. A connector fitting construction comprising:

a first connector comprising a first housing including a first terminal receiving chamber into which a first terminal is insertable;

a second connector comprising a second housing including a second terminal receiving chamber into which a second terminal is insertable, and a resilient member provided in the second housing, wherein the first connector and the second connector are fittable to each other so that the first terminal and the second terminal are connected with each other, and a half-fitted condition between the first connector and the second connector is prevented by a resilient force of the resilient member;

side ribs formed respectively on opposite sides of the first housing, the side ribs extending in a connector fitting direction; and side rib-receiving portions respectively receiving the side ribs when the first connector and the second connector are fitted to each other, the side rib-receiving portions being formed in an inner surface of the second housing;

wherein the second connector further comprises an inner housing provided on the second housing, the first connector further comprises a housing insertion opening into which the inner housing of the second connector is insertable, and a bracket formed on an outer surface of the first housing, the bracket serving as one side wall of the housing insertion opening and a notch is formed in one side wall of the second housing corresponding to the bracket.

2. A connector fitting construction according to claim 1, wherein the second connector further comprises an under-rib formed on an outer surface of the inner housing of the second connector, the first connector further comprises an under-rib receiving portion into which the under-rib is insertable, the under-rib receiving portion being formed in the bracket.

* * * * *